United States Patent [19]

Burry

[11] Patent Number: 4,457,030

[45] Date of Patent: Jul. 3, 1984

[54] WASTE OUTLET FITTINGS

[76] Inventor: Russell D. Burry, 1 Sulby Rd., Thorpland's Brook Northampton, England

[21] Appl. No.: 495,174

[22] Filed: May 17, 1983

[30] Foreign Application Priority Data

May 18, 1982 [GB] United Kingdom ..... 8214358

[51] Int. Cl.[3] ..... A47K 1/14

[52] U.S. Cl. ..... 4/286; 4/295; 4/191; 220/238; 215/311

[58] Field of Search ..... 4/286–295, 4/191, 195, 197, 204, 205, 208, 301; 251/298, 365, 369, 313; 215/311, 312; 220/233, 234, 238, 237; 138/89

[56] References Cited

U.S. PATENT DOCUMENTS 1,149,529 8/1915 McGary ..... 4/301
2,817,489 12/1957 Hesmer ..... 251/305
2,862,685 12/1958 Lundberg ..... 251/305
3,291,443 12/1966 Schulz et al. ..... 251/305
4,144,599 3/1979 Cuscheva ..... 4/286

*Primary Examiner*—Stephen Marcus
*Assistant Examiner*—Kenneth S. Putnam
*Attorney, Agent, or Firm*—Scrivener, Clarke, Scrivener and Johnson

[57] ABSTRACT

A waste outlet fitting for a bath, basin, sink or the like comprises a tubular body in which a plug is captively mounted. The plug includes a part-spherical periphery which is complementary to a part-spherical seat formed in the tubular body. The plug may be rotated between the closed position shown and an open position in which the plug member stands up-right within the tubular body by application of finger pressure to the edge of the plug. The tubular body may comprise an outer tubular member and insert member as illustrated, or may be in the form of an integral plastics moulding.

6 Claims, 5 Drawing Figures

WASTE OUTLET FITTINGS

This invention relates to waste outlet fittings for use with baths, basins, sinks, and the like.

Traditionally, waste outlet fittings for baths, basins, sinks and the like have included a metal tubular member which is sealingly received in a waste outlet opening of the bath, etc. and to which a waste pipe is connected. The tubular member defines a tapering seat which receives a complementary tapering removable plug to close the waste outlet when it is desired to fill the bath, etc. with water. The plug is ususlly completely separate from the tubular member, and is secured to the end of a retaining chain, but it is known to make the plug captive to the tubular member and to dispense with the chain. In the latter case, the plug may be remotely actuated.

Prior art waste outlet fittings suffer from a number of disadvantages, the greatest of which is probably that the plug tends to form a poor seal with its associated seat. The usual non-captive plug is formed of hard plastics material and does not as a practical matter form a good seal with its seat. If the plug is instead made of a softer elastomeric material a better seal is formed but the plug tends to stick in the seat and also tends to deteriorate rapidly. Captive plugs are often of metal, but again tend to form a poor seal, partly because they cannot be manufactured to a taper which accurately matches that of the seat or they will tend to jam in place, and partly because any debris between the plug and seat or surface projections on the plug or seat prevent intimate sealing contact between the plug and the seat. A further problem is that the traditional chain used to hold a non-captive plug is unsightly and tend to damage the sanitary ware over the years. The captive plug tends to eliminate this problem but has proved expensive to manufacture.

According to the present invention there is provided a waste outlet fitting comprising: a tubular body which, in use, is sealingly mounted in a waste outlet opening; a longitudinally extending waste flow passage defined within the tubular body; a seat defined within the tubular body surrounding the flow passage; and a plug rotatably mounted in the body for manipulation by hand between a closed position in which the periphery of the plug sealingly engages the seat and the plug extends across the flow passage to close the flow passage to fluid flow, and an open position in which portions of the periphery of the plug are spaced from the seat to permit fluid flow through the flow passage on both sides of the plug.

In the preferred embodiment of the invention the seat is part-spherical in shape, and the plug is in the form of a disc having a complementary part-spherical periphery. The plug may, therefore, be located across the flow passage with the entire plug periphery in contact with its associated seat, and may be moved from this position to an open position in which it stands generally up-right within the body simply by pressing any point on the periphery of the plug to rotate the plug about any horizontal axis transverse to the longitudinal direction of the waste fitting and passing through the centroid of the part-sphere defined by the seat and plug.

Such a waste fitting is not only pleasing in appearance and relatively economic to manufacture, but provides an excellent seal between the plug and the body. The excellent seal is in part due to the fact that the mating sperical surfaces can be formed to be precisely complementary without any fear that the plug will jam in the seat, and partly because the rotary action of opening and closing the plug tends to dislodge any debris located between the plug and the seat, and tends to maintain a good mating relationship between the plug and its seat.

The above and further features and advantages of the invention will become clear from the following description of preferred embodiments thereof, given by way of example only, reference being had to the accompanying drawings wherein.

Figure 1:
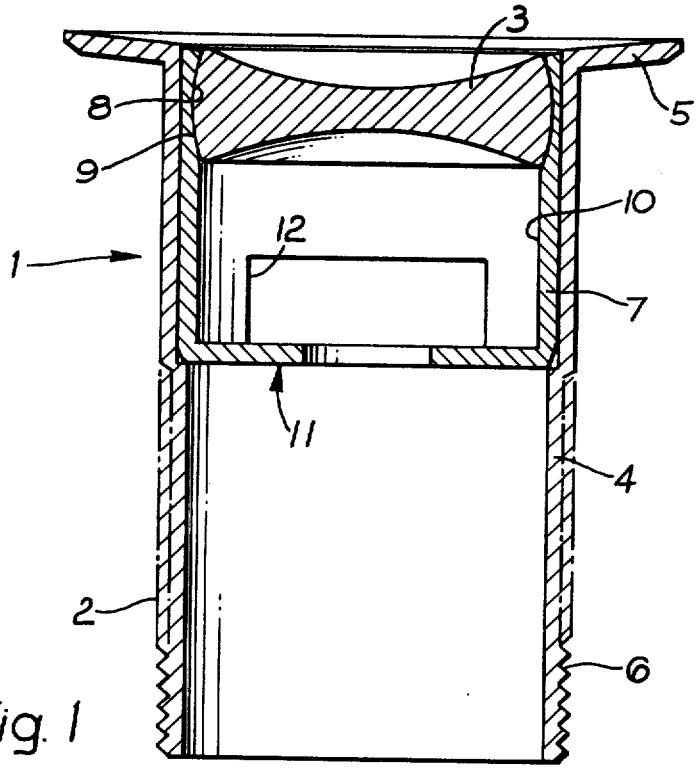
FIG. 1 is a cross-sectional view of a preferred embodiment of the invention.
Figure 2:
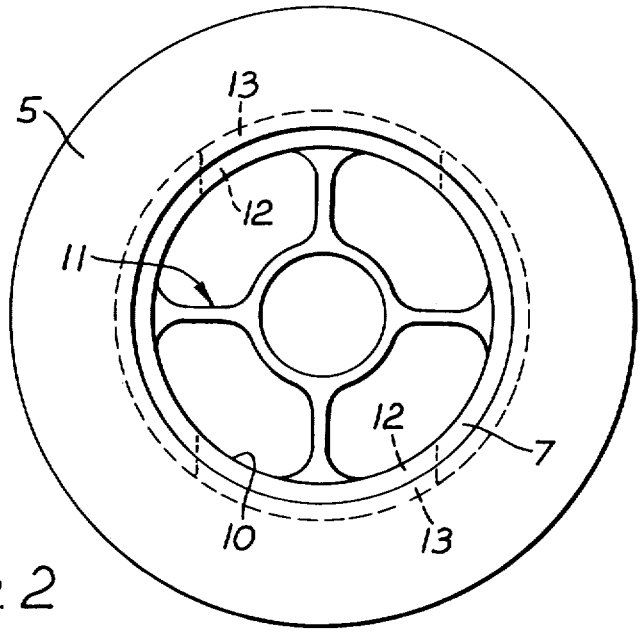
FIG. 2 is a plan view of the fitting of FIG. 1 with the plug omitted.
Figure 3:
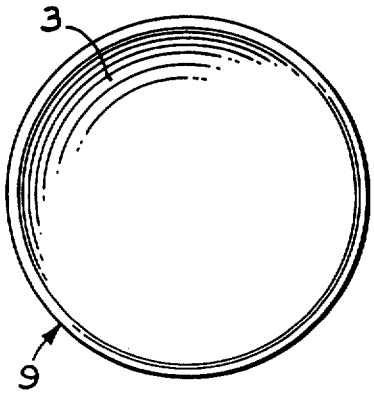
FIGS. 3 and 4 are respectively plan and sectional views of a plug.
Figure 4:
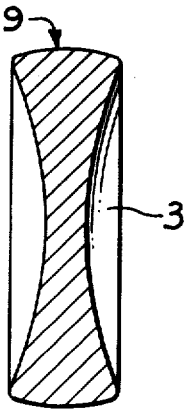

Referring firstly to FIG. 1 the waste outlet fitting 1 comprises a tubular body 2 and a plug 3. The tubular body 2 comprises a tubular member 4 having an outwardly extending flange 5 at the upper end thereof and external screw-threads 6 at the lower end thereof. In use, the tubular member 4 is sealingly mounted in a waste outlet opening of a bath, basin, sink or the like and a waste pipe is connected to the lower end thereof, as will be well understood by those skilled in the art. The tubular body 2 also includes an insert member 7 located within a counter-bore at the upper end of the tubular member 4. The insert member defines a part-spherical seat 8 in which the plug 3 is captive.

The plug 3 itself is generally disc-like shape and includes a part-spherical periphery 9 complementary to the seat 8. Thus, when the plug 3 is in the closed position illustrated in FIG. 1 the periphery 9 sealingly engages the seat 8 and the body of the plug extends across the flow passageway 10 defined within the tubular body 2 in order to close the flow passageway to fluid flow. When it is desired to open the flow passageway 10, finger pressure is applied to any point on the upper surface of the plug 3 adjacent the periphery thereof and the plug is swivelled to a generally up-right configuration about a horizontal axis passing through the centroid of the part-sphere defined by the seat and plug. In this up-right configuration the majority of the periphery 9 of the plug is spaced from the seat and fluid may flow through the flow passageway 10 on either side of the plug 3. The plug is devoid of any actuating mechanism. Whereby it may be moved between its open and closed positions solely by application of finger pressure adjacent the periphery of the plug.

It will be noted that the insert member 7 defines a grill 11 located below the plug in order to prevent accidental loss of items through the waste fitting. Also, the insert member 7 includes slots 12 which register with corresponding slots 13 of the body 2 in order to receive an overflow connection as is well known in the art.

The plug 3, tubular member 4, and insert member 7 may be manufactured from any suitable materials. For example, the body member 4 and plug 3 may be manufactured from brass which may be plated, and the insert member 7 may be injection moulded from a suitable plastics material, for example polyethylene or polypropylene. In the alternative, the plug may be manufactured from a plastics material, for example acetal or ABS.

Figure 5:
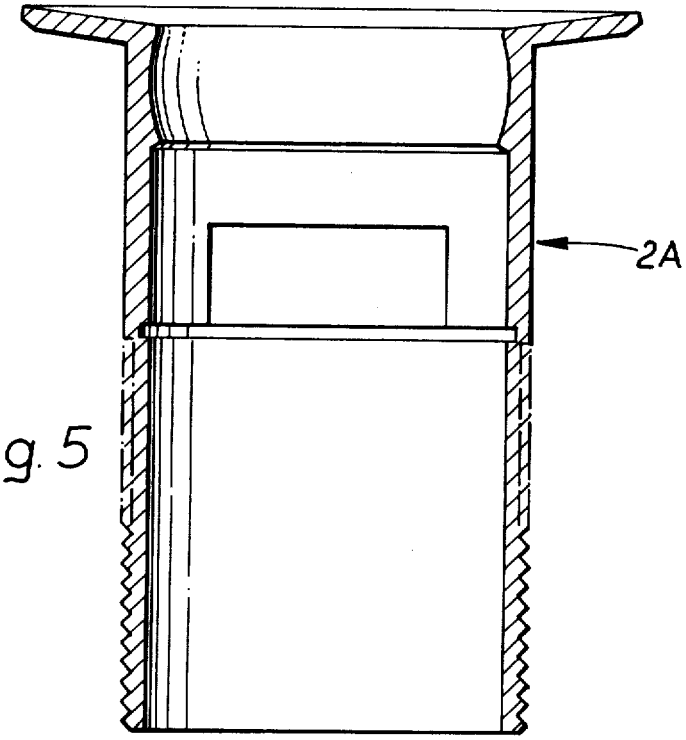
FIG. 5 is a cross-sectional view of a modified body.

Referring now to FIG. 5, a modified tubular body 2A is shown. This body is formed as a plastics one-piece moulding and accordingly replaces the body member 4 and insert member 7 of FIG. 1. A groove 14 is provided in the tubular body 2A in order to receive a grill member to prevent accidental loss of items through the fitting. The tubular body 2 may be formed of any suitable plastics material, and can be used with a metal or plastics plug as described above. In a modified moulded plastics body the groove 14 is omitted and a plastics grill moulded integrally with the body is provided instead.

I claim:

1. A waste outlet fitting comprising: a tubular body which, in use, is sealingly mounted in a waste outlet opening; a longitudinally extending waste flow passage defined within the tubular body; a seat defined within the tubular body; a seat defined within the tubular body surrounding the flow passage; and a circular disc-like plug mounted in the body for manipulation by hand between a closed position in which the periphery of the plug sealingly engages the seat and the plug extends across the flow passage to close the flow passage to fluid flow, and an open position in which portions of the periphery of the plug are spaced from the seat to permit fluid flow through the flow passage, wherein the plug periphery and seat are of mating part-spherical shape, the plug being held in the tubular body solely by interaction of the part-spherical periphery of the plug with the mating part-spherical seat whereby the plug can be rotated about any horizontal axis passing through the centroid of the part-sphere by finger pressure on the plug to move the plug between its closed and open positions.

2. A waste outlet fitting according to claim 1 wherein the tubular body comprises: a tubular member which, in use, is sealingly mounted in a waste outlet opening; and an insert member mounted within the tubular member and defining the seat.

3. A waste outlet fitting according to claim 2 wherein the insert member is formed integrally with a grill which extends across the flow passage.

4. A waste outlet fitting according to claim 2 wherein the tubular member is of metal and the insert member is a plastics moulding.

5. A waste outlet fitting according to claim 1 wherein the tubular body is an integral unitary plastics moulding.

6. A waste outlet fitting for a bath, basin, sink or the like comprising: a tubular body which, in use, is sealingly mounted in a waste outlet opening of the bath, basin, sink or the like; a longitudinally extending waste flow passage defined within the tubular body; a part-spherical seat defined within the tubular body surrounding the flow passage; and a circular disc-like plug having a part-spherical periphery, the plug being mounted in the tubular body for rotational movement between a closed position in which the part spherical periphery of the plug is in mating engagement with the part-spherical seat to close the flow passage to fluid flow, and an open position in which portions of the plug periphery are spaced from the seat to permit fluid flow through the flow passage on both sides of the plug, the plug being devoid of any actuating mechanism whereby it may be moved from the closed position to the open position solely by application of finger pressure to a point on the upper surface thereof adjacent the periphery.

* * * * *

UNITED STATES PATENT AND TRADEMARK OFFICE

CERTIFICATE OF CORRECTION

PATENT NO. : 4,457,030

DATED : July 3, 1984

INVENTOR(S) : Russell D. Burry

It is certified that error appears in the above-identified patent and that said Letters Patent is hereby corrected as shown below:

Column 3, line 14, delete "a seat defined within".
Column 3, line 15, delete "the tubular body;" (first occurrence).

Signed and Sealed this

Eighth Day of March, 1994

Bruce Lehman

*Attest:*

BRUCE LEHMAN

*Attesting Officer*

*Commissioner of Patents and Trademarks*